US007785062B2

(12) United States Patent
Fischereder

(10) Patent No.: US 7,785,062 B2
(45) Date of Patent: Aug. 31, 2010

(54) SEPARATING DEVICE

(75) Inventor: Bernhard Fischereder, Vöcklabruck (AT)

(73) Assignee: Trumpf Maschinen Austria GmbH & Co. Kg., Pasching (AT)

( * ) Notice: Subject to any disclaimer, the term of this patent is extended or adjusted under 35 U.S.C. 154(b) by 270 days.

(21) Appl. No.: 11/876,339

(22) Filed: Oct. 22, 2007

(65) Prior Publication Data

US 2008/0226438 A1 Sep. 18, 2008

(30) Foreign Application Priority Data

Oct. 20, 2006 (AU) ..... A 1766/2006

(51) Int. Cl.
*B65H 29/00* (2006.01)

(52) U.S. Cl. ..... 414/795.8; 414/222.04; 414/796.9

(58) Field of Classification Search ..... 108/55.3; 198/345.3, 346; 269/309, 54.4, 69; 414/222.04–222.06, 414/401, 416.08, 795.4, 795.7, 795.8, 796.5, 414/796.9, 797, 979.1, 799; 483/14
See application file for complete search history.

(56) References Cited

U.S. PATENT DOCUMENTS 3,977,539 A * 8/1976 Hauschild ..... 414/797
4,024,963 A * 5/1977 Hautau ..... 414/795.3
4,915,033 A * 4/1990 Bond ..... 108/55.1
5,190,434 A * 3/1993 Miura et al. ..... 414/609
5,263,569 A * 11/1993 Hiramoto et al. ..... 198/468.4
5,899,341 A * 5/1999 Irita ..... 209/571
6,938,454 B2 9/2005 Strasser et al.
2005/0196263 A1* 9/2005 Tamura ..... 414/744.5

FOREIGN PATENT DOCUMENTS

JP 58141819 8/1983
JP 5123785 5/1993
JP 7155874 6/1995

OTHER PUBLICATIONS

Office Action issued Jul. 18, 2007 in corresponding Austrian Priority Application A 1766/2006.

* cited by examiner

*Primary Examiner*—Gregory W Adams
(74) *Attorney, Agent, or Firm*—Alston & Bird LLP

(57) ABSTRACT

The invention relates to a separating device (1) with a manipulating device (5) and with at least one carrier support (2) with at least one stacking shaft (3) for workpieces (4) disposed on it, in particular metal plates made ready for a bending operation on a bending press, and with a gripping mechanism (14) for removing the workpiece (4) from the stacking shaft (3) and transporting the workpiece (4) from a pick-up position into a transfer position. The manipulating device (5) and the carrier support (2) are positioned relative to one another by means of positioning means (65), and at least one fixed positioning space (27) for the carrier support (2) is provided in a reference position of the stacking shaft (3) with respect to the manipulating device (5).

32 Claims, 5 Drawing Sheets

SEPARATING DEVICE

BACKGROUND OF THE INVENTION

1. Field of the Invention

The invention relates to a separating device having a manipulating device and at least one carrier support that includes at least one stacking shaft for workpieces (in particular metal plates made ready for a bending operation on a bending press) disposed on it, and having a gripping mechanism for removing the workpiece from the stacking shaft and conveying the workpiece from a pick-up position into a transfer position.

2. Prior Art

To operate a bending press on an automated basis whereby workpieces prepared in readiness for a bending operation are fed to the bending press by means of a handling device, in particular a multi-axis robot, a known approach is to place the workpieces in a stack on a carrier support, in particular a transport pallet, in the access region of the handling device.

Patent specification WO 03/095125 A2 owned by this applicant discloses a handling device with a gripping mechanism equipped with a vacuum gripping finger and an optoelectronic positioning mechanism for picking up workpieces waiting in readiness and feeding the workpieces to a bending press for a bending operation. With this design of gripping mechanism for picking up a workpiece from workpieces stored in a stack on a carrier support, the gripping mechanism is firstly positioned and then the workpiece is picked up by placing the vacuum suction finger on its surface, but in order to pick it up by means of pince grippers of the type used for specific bending operations means that the workpiece has to be deposited again to enable the gripping operation to proceed.

OBJECTIVES AND ADVANTAGES OF THE INVENTION

The objective of the invention is to propose a separating device by means of which workpieces stacked on a carrier support can be exactly pre-positioned and a separated workpiece can be selectively picked up both with a suction gripper and with pince grippers.

This objective is achieved by providing the manipulating device and the carrier support with positioning recesses and positioning projections, respectively, which allow the carrier support to be specifically positioned relative to the manipulating device by engaging the positioning projections of the carrier support in the positioning recesses of the manipulating device. In this way, a stacking shaft (which holds a stack of workpieces) of the carrier support is fixed in a reference position with respect to an end position of the gripping mechanism. The surprising advantage obtained is that by setting a unique disposition between the manipulating device and a storage position of a workpiece to be picked up from the carrier support from a storage position or a stack, the latter can be moved into a unique defined transfer position for a gripping mechanism of a feeding system, e.g. robot, and from there can be picked up without additional positioning maneuvers and saving on positioning time and the carrier support can then be exchanged on an automated basis saving on set-up time.

The reference position can be fixed by an X-coordinate of the center point of the carrier support by reference to an end position of the gripping mechanism in the X-axis direction and by a normal distance of the center point from the X-axis. Alternatively, the reference position can be fixed by an X-coordinate of an intersection point of adjoining side faces of the carrier support extending at a right angle to one another by reference to an end position of the gripping mechanism in the X-axis direction, and by a distance between the X-axis and a side face of the carrier support oriented parallel with the X-axis. As a result, an exact relative disposition is achieved between a handling device and a carrier support for workpieces stored in a stacking shaft in order to separate them.

In another possible embodiment, the manipulating device has a linear guide mechanism disposed on the standing surface and a tower-shaped housing extending perpendicular to the standing surface and displaceably guided in the linear guide mechanism by a displacement drive, on which the gripping mechanism is mounted so that the gripping mechanism can be displaced in the X-axis direction, whereby even when workpieces have been separated from a number of stacking shafts, an exactly defined transfer position can be obtained due to an end position of the gripping mechanism and hence the separated workpiece.

Also of advantage is an embodiment in which the gripping mechanism is provided in the form of a panel with at least one gripping finger, which is mounted so that the gripping mechanism can be displaced on the housing in a linear guide mechanism, because the feeding operation by the gripping mechanism can be adapted to requirements in terms of the number and design of gripping fingers.

It is possible in a further embodiment for a displacement drive for the gripping mechanism to be integrated in the housing, whereby a compact design of the gripping mechanism is achieved.

Also of advantage are embodiments in which the displacement drives are actuators operated by pressurized fluid (e.g., pneumatic cylinders, hydraulic cylinders, etc.) or are electric actuator drives, whereby technically proven actuators designed for long periods of operation with a high repetition accuracy in terms of the motion sequences can be used.

Advantageous embodiments are also described herein in which the gripping finger is provided in the form of a support arm retained on the panel so as to be displaceable and, connected to the support arm, a spacer element extending in the direction of the standing surface. A gripper (e.g., a vacuum gripper, and electromagnet, etc.) is provided on an end region of the spacer element facing the standing surface. These embodiments are advantageous because a stacking shaft height for stacking a specific number of workpieces is obtained.

In further embodiments, the gripper comprises a vacuum gripper and the spacer element is connected to a vacuum generator via a pressure line, and it is possible for a shut-off valve to be provided in the pressure line. Alternatively, the gripper comprises an electromagnet and is connected via a line to a switching means of a control and regulating system of the separating device. In this manner, the feeding operation by the gripping means and the process of switching them on and off individually can be adapted to the respective application.

Also described herein are embodiments, in which the carrier support is provided in the form of a supporting board that has receiving means in a top face thereof for receiving a plurality of shaft dividers forming each stacking shaft. The receiving means can be pro-vided in the form of several receiving grooves extending at right-angles with respect to one another. The shaft dividers are provided in the form of panel-shaped wall parts retained in receiving grooves. By such a construction, an exact orientation and hold is obtained and the stacking shaft is also adapted to the workpieces to be stacked.

Other advantageous embodiments are defined, whereby a transfer position of the individual workpiece can be selectively obtained, either in a plane extending parallel with the standing surface or in a plane extending perpendicular to the standing surface, which saves on a motion sequence in the downstream feeding system for speeding up the feeding operation, thereby reducing programming complexity when configuring the control system of the feeding system.

In other advantageous embodiments defined herein, the gripping mechanism includes a measuring device for detecting when the gripping mechanism has picked up two workpieces adhered together. The measuring device can be a force-measuring sensor (e.g., a strain gauge) on the gripping mechanism. This provides a status monitoring system for the gripping mechanism and errors in the production sequence are effectively avoided because situations in which workpieces adhere to one another are effectively avoided.

Finally, a further embodiment having a releasing device (e.g., electromagnet, permanent magnet, etc.) disposed in the area where the gripping mechanism moves and operable to separate a second workpiece from the top workpiece gripped by the gripping mechanism is of advantage because the second workpiece is separated before the workpiece is transferred by a feeding system.

BRIEF DESCRIPTION OF THE DRAWINGS

To provide a clearer understanding, the invention will be described in more detail with reference to examples of embodiments illustrated in the appended drawings. Of these.

DETAILED DESCRIPTION OF PREFERRED EMBODIMENTS

Figure 1:
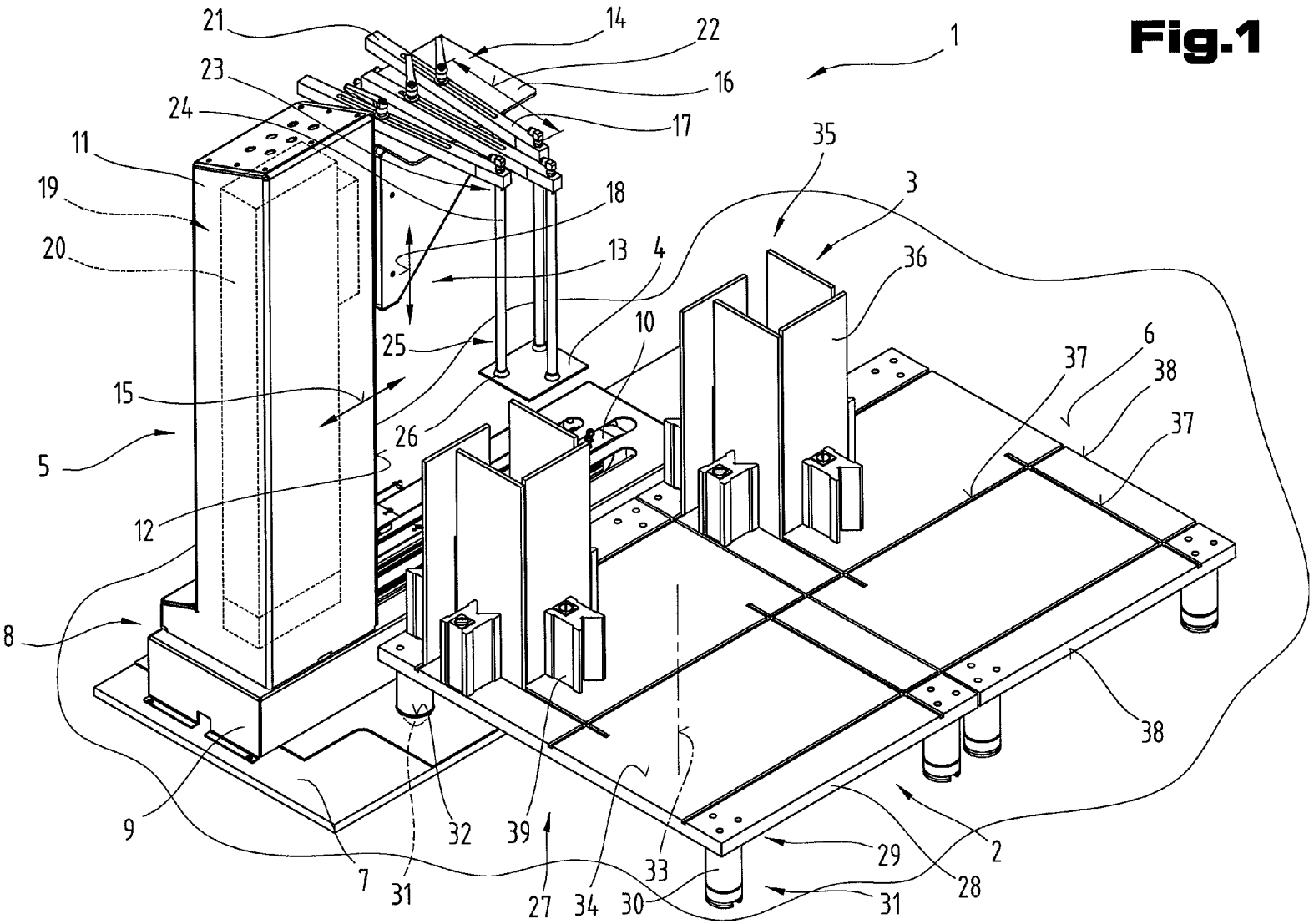
FIG. 1 is a schematic diagram illustrating a separating device proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Figure 2:
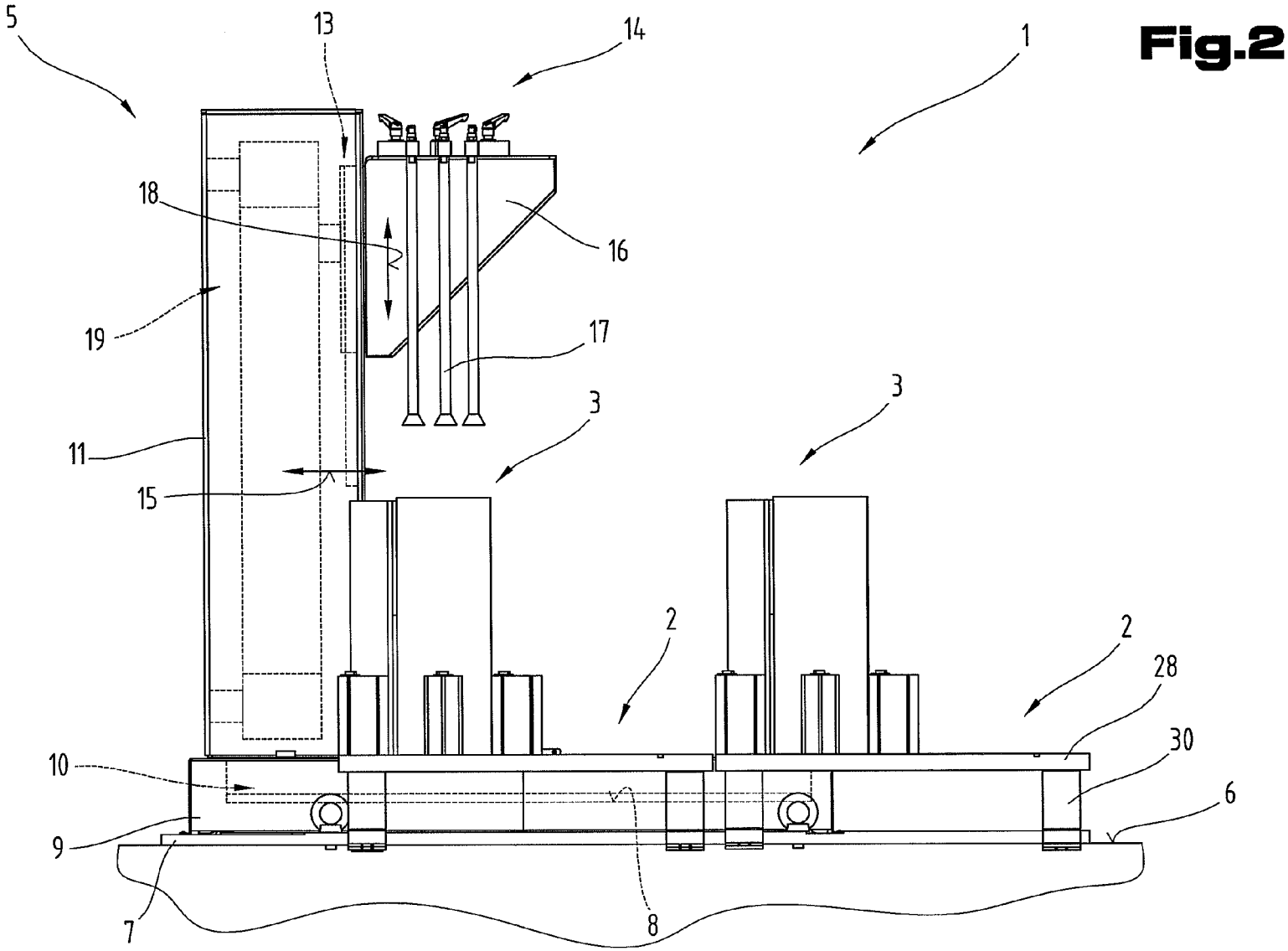
FIG. 2 is a view in partial section illustrating the separating device proposed by the invention.
Figure 3:
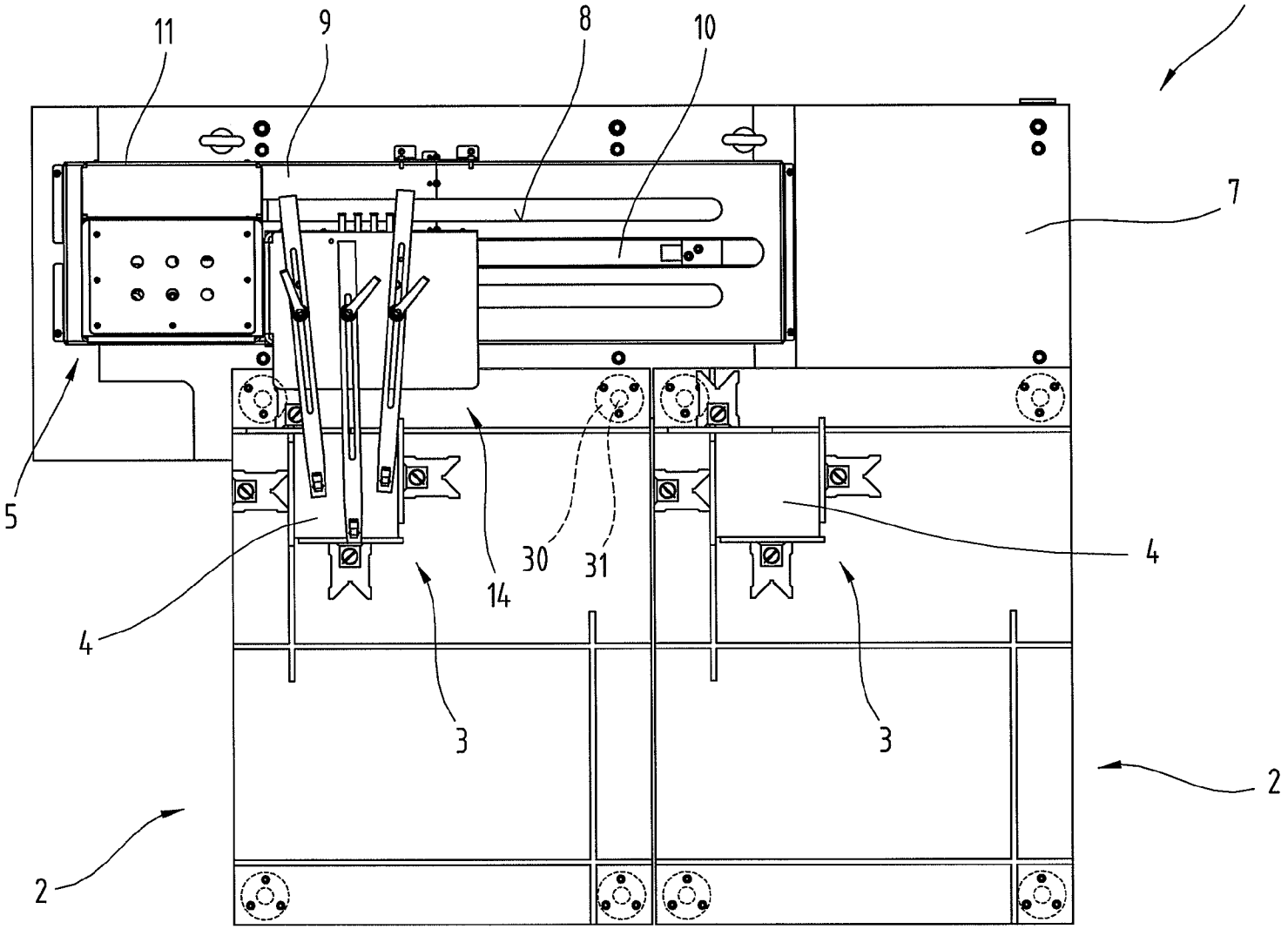
FIG. 3 is a plan view of the separating device proposed by the invention.

FIGS. 1 to 3 illustrate a separating device 1 for individually removing workpieces 4 stacked in stacking shafts 3 on a pallet-type carrier support 2, in particular flat workpieces 4, with a manipulating device 5.

In the embodiment illustrated as an example, the manipulating device 5 comprises a 2-axis manipulator. Secured to the standing surface 6 is a base plate 7, on which a linear guide mechanism 8 is disposed, comprising a housing 9 in which a displacement drive 10 is disposed or integrated, for example a cylinder which can be pressurized by a pressurizing medium or an electrically operated spindle drive, cable or belt drive, etc.

The linear guide mechanism 8 provides a displaceable mount for a housing 11 extending in the direction perpendicular to the bearing surface 6, forming another linear guide mechanism 13 on a side wall 12 in which a gripping mechanism 14 comprising a panel 16 projecting out from the housing 9 in a displacement direction—indicated by double arrow 15—with gripping fingers 17 disposed on it is disposed and which is mounted so as to be displaceable in the direction perpendicular to the bearing surface 6—as indicated by double arrow 18.

Another displacement drive 19 is disposed in the housing 11, for example an actuator cylinder 20, for the panel 16.

In the embodiment illustrated, the manipulating device 5 is configured so that the gripping mechanism 14 can be moved in two axial directions extending perpendicular to one another, for example an X-axis—as indicated by double arrow 15—and a Y-axis—as indicated by double arrow 18.

The gripping fingers 17 disposed on the panel 16 comprise support arms 21 mounted on the panel 16, extending more or less parallel with the standing surface 6, which can be displaced on the panel 16 in an extension length 22 and positioned relative to one another, e.g. the support arms 21 are provided with elongate slots and are releasably secured to the panel 16 by means of capstan-headed screws.

Disposed on a projecting end region 23 of the support arm 21 is a spacing element, e.g. a pressure pipe 24, projecting in the direction of the standing surface 6, which is provided with a vacuum sucker 26 at an end 25 facing the standing surface 6.

As illustrated, it would naturally also be possible to provide several such gripping fingers 17 on the panel 16 and adjust them to an appropriate position for picking up the stacked workpiece 4 using an appropriate adjustment. It is therefore manually possible to provide one of the gripping fingers 17 or alternatively several of the gripping fingers 17 for picking up the workpiece 4 depending on its size or shape.

Disposed in the gripping area of the gripping mechanism 14 is at least one positioning space 27 for the carrier support 2 on the standing surface 6, and the carrier support 2 preferably comprises a supporting board 28 with stacking shafts 3 disposed on a top face and the supporting board 28 is supported on the standing surface 6 or the base plate 7 by means of spacer elements 30, preferably in corner regions 29.

The spacer elements 30 are provided in the form of positioning projections 31 in the standing area, e.g. conical end regions of which at least two adjacent positioning projections 31 locate in centering recesses 32, which are preferably disposed in the base plate 7 of the manipulating device 5, so that the positioning space 27 respectively the carrier support 2 respectively a stacking shaft 3 assumes a defined reference position—as will be explained in more detail below—by reference to the manipulating device 5. The design of the spacer elements 30 with the positioning projections 31 and the centering recesses 32 ensures that the reference position is always assumed when carrier supports 2 are replaced without the need for complex positioning maneuvers.

Due to the layout of the positioning projections 31 on the spacer elements 30 in the corner regions of the carrier support 2 and two centering recesses 32 in the base plate 7, a carrier support 2 is turned by 180° about a center axis oriented at a right-angle to the standing surface 6 through a surface center point 33 of the carrier support 2 in the case of a carrier support with a rectangular format, for example, or, in the case of a carrier support 2 of a square format, by 90°. This also enables several stacking shafts 3 to be provided on the supporting board 28, for example two stacking shafts 3 if using carrier supports 2 of rectangular format or four if using a square format, without having to undertake changes in the control program to activate the manipulating device 5.

As may be seen from the embodiment illustrated as an example, it is naturally also possible to provide several positioning spaces 27 in the direction of displacement—indicated by double arrow 15—aligned in rows if the displacement path of the tower-shaped housing 11 in the linear guide mechanism 8 is correspondingly long.

In the embodiment illustrated as an example, the stacking shaft 3 comprises flat shaft dividers 35 oriented perpendicular to a surface 34, for example sheet metal wall parts 36. In order to position the shaft dividers 35, receiving grooves 37 are provided in a lattice pattern in the top face 34 of the carrier supports 2, which preferably extend at a right-angle with respect to one another and are disposed parallel with side faces 38 of the supporting board 28 and receiving grooves 37 respectively lying opposite one another at a same normal distance from the surface center point 33.

The right-angled disposition of the receiving grooves 37 offers a simple way of ensuring that two adjoining wall parts 36 inserted in two adjacent receiving grooves 37 form contact planes oriented exactly at a right-angle with one another for workpieces 4 with a rectangular corner region without the need for complex positioning.

One or more other wall parts 36 may also be used to position the workpieces 4 in the stacking shaft 3 by mutual positioning, which are positioned in alignment on the top face 34 of the supporting board 28 and held in position by means of standard permanent magnets 39.

Naturally, it would also be possible to dispose the supporting board 28 in a lattice system with clamping grooves in which blocks with threaded bores can be displaceably inserted and the wall parts 36 secured in the vertical position and relevant layout by means of screws matching the configuration of the workpieces 4 on the top face 34 of the supporting board 28.

Figure 4:
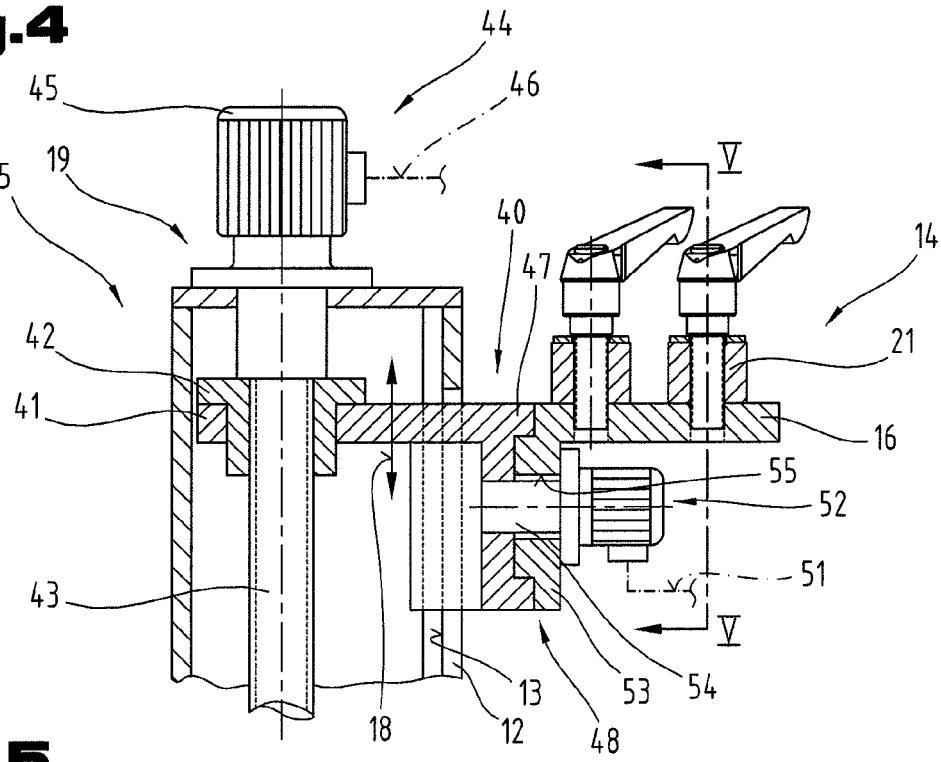
FIG. 4 illustrates a part-region of a different embodiment of the manipulating device of the separating device proposed by the invention, viewed in section along line IV-IV indicated in FIG. 5.
Figure 5:
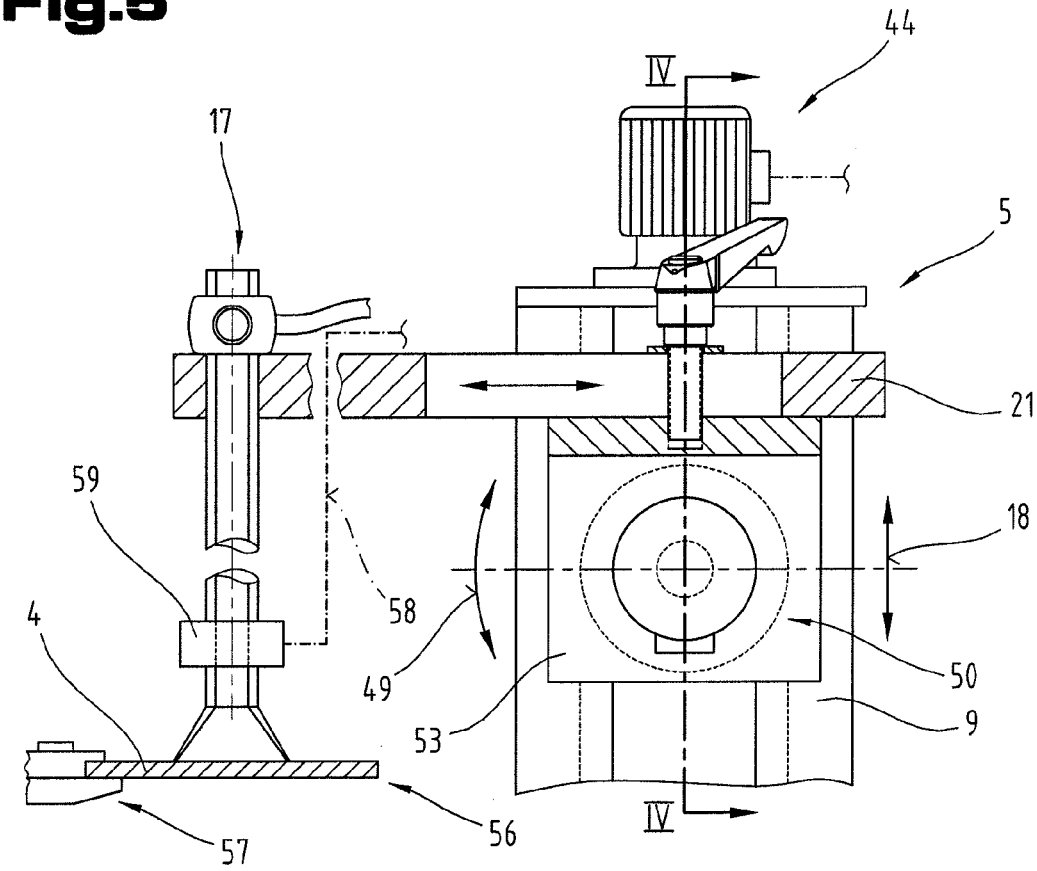
FIG. 5 shows the part-region of the manipulating device, viewed in section along line V-V indicated in FIG. 4.

FIGS. 4 and 5 illustrate a different embodiment of the manipulating device 5 of the separating device proposed by the invention. The side wall 12 of the tower-shaped housing 9 has the linear guide mechanism 13 for a carriage 40 guided in it, which extends into an interior of the housing 9 by means of a driver extension 41. Anchored in the driver extension 41 is a spindle nut 42 which is drivingly connected to a threaded spindle 43 extending into the housing 9. A drive 44 is provided for the threaded spindle 43 by means of an electric motor 45 flange-mounted on a cover plate 45 of the housing 9, in particular a servomotor, which is connected via a line 46 to a control system of the separating device, although this is not illustrated. It is by this that the carriage 40 and hence the panel 16 with the gripping fingers 17 disposed on the carriage is displaced as described above—as indicated by double arrow 18.

The panel 16 is mounted in an end plate 47 of the carriage 40 so that it can pivot in a pivot arrangement 48—as indicated by double arrow 49—for which purpose a pivot drive 50 is provided, for example an electrically driven servomotor 52, connected via a line 51 to the control system, although the latter is not illustrated.

In the embodiment illustrated as an example, the servomotor 52 is flange-mounted on a leg 53 of the panel 16 extending parallel with the end plate 47, thereby resulting in a non-rotating connection of a motor housing to the panel 16. A drive stub 54 of the servomotor 52 extends through the leg 53 in a releasing bore 55 and is non-rotatingly coupled with the end plate 47 of the carriage 40. Consequently, activating the servomotor 52 via the line 51 causes the pivoting movement of the panel 16 with the gripping fingers 17. It appears to be sufficient to set a pivoting movement of +/−90° starting from a horizontal position of the support arms 21. The embodiment illustrated in FIGS. 4 and 5 provides, in addition to the X-axis and Y-axis, a third axis of movement on the manipulating device 5, which enables the workpiece 4 removed from the stacking shaft to be pivoted out of a transfer position for a gripping means, e.g. gripping pincers 57 or a feeding system such as a multi-axis robot, not illustrated, from a transfer position 56 parallel with the standing surface into a vertical position and thus if necessary a transfer position which makes it easier for a gripping mechanism of a robot to pick up the workpiece 4.

As may also be seen from FIGS. 4 and 5, it would naturally also be possible for the gripping finger or fingers 17 to be provided with a force measuring sensor 59 connected via a line 58 to the control system, not illustrated, so that a weight check can be run using weight values stored in the control system once the workpiece 4 has been picked up in order to detect whether two workpieces 4 adhered to one another have been picked up—as may occur due to an adhesion force or bonding or hooking for example—in which case the double pick-up which would otherwise disrupt operation can be effectively eliminated by dispensing the picked-up workpieces 4 into a collection container.

However, it would also be possible to use a capacitive measuring system or to measure the vibration behavior of the picked-up workpiece in a manner known from the prior art as a means of detecting a "double pick-up".

It should also be pointed out that an electrically operated spindle drive of this type, described in connection with FIGS. 4 and 5 for the Y-axis, could naturally also be used as an actuator drive for displacing the tower-shaped housing 9 in the X-axis as described in connection with FIGS. 1 to 3.

It should also be pointed out that it would also be possible to use a separating device of the type known from the prior art. Such a device may be positioned alongside the manipulating device 5 in the area in which the gripping mechanism 14 moves, thereby enabling an adhered workpiece to be separated due to a magnetic effect or on a mechanical basis.

Figure 6:
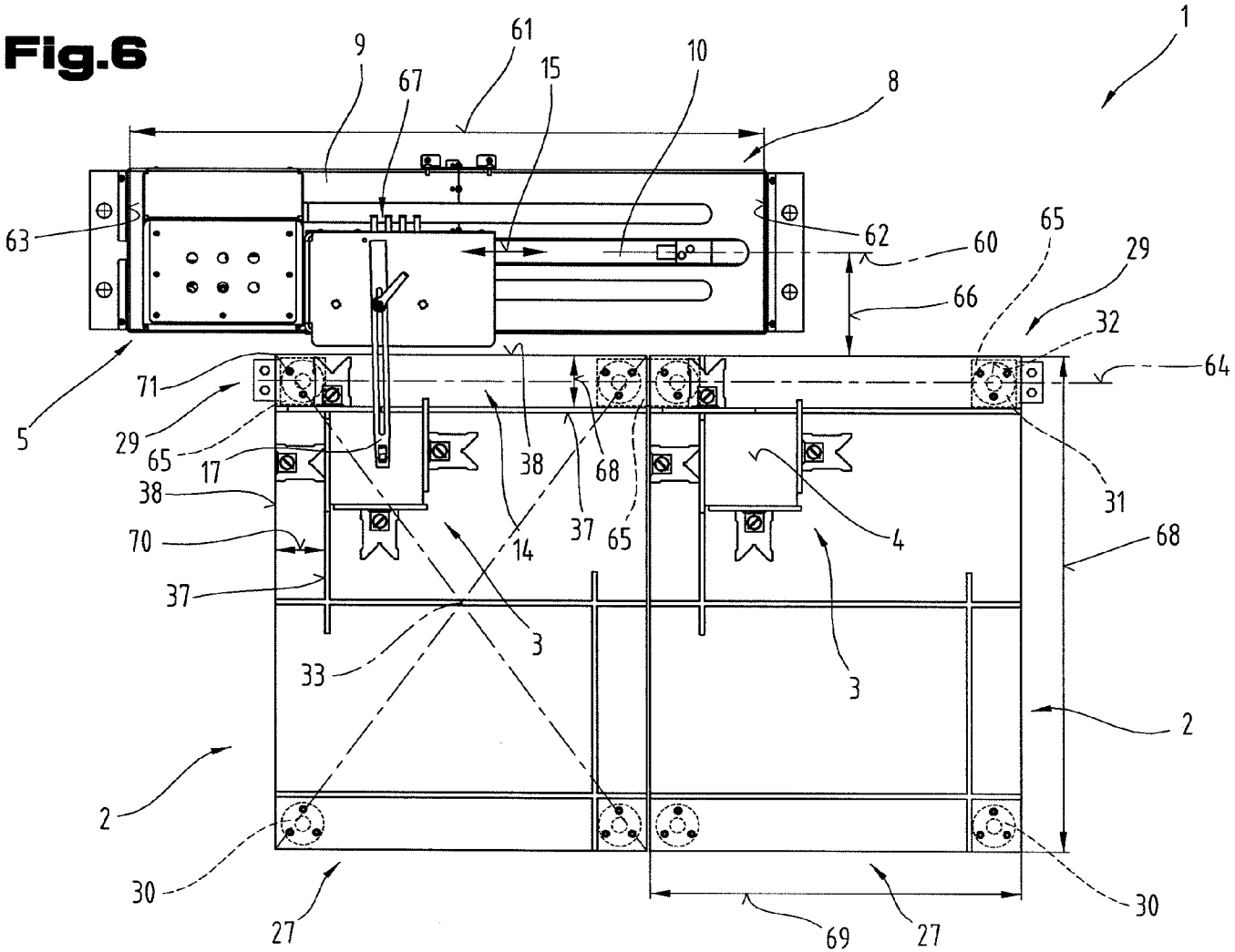
FIG. 6 is a plan view of another embodiment of the separating device proposed by the invention.

FIG. 6 illustrates the positioning of the carrier support 2 by reference to the manipulating device 5 in order to obtain a reference position for at least one stacking shaft 3 disposed on the carrier support 2 and this procedure will be explained with reference to this drawing.

In the embodiment illustrated as an example, the manipulating device 5 with the gripping mechanism 14 is assigned two positioning spaces 27 for a respective carrier support 2 with rectangular dimensions, preferably in a half format of a Euro-pallet. As illustrated, due to the receiving grooves 37 disposed in a lattice pattern, a stacking shaft 3 is disposed on each of the carrier supports 2 in a defined position by reference to the side faces 37 adjoining one another at a right-angle. Naturally, it would also possible to provide other stacking shafts 3 on the carrier support 2.

The linear guide mechanism 8 with the linear drive 10 of the manipulating device 5 is secured to the standing surface 6, thereby predefining an X-axis 60 for the displacement of the gripping mechanism 14, and a displacement path—indicated by double arrow 15—in the direction of the X-axis 60 is predefined by the linear guide mechanism 8 and by a distance 61 between oppositely lying, adjustable end stops 62, 63.

In connection with the X-axis 60 in the embodiment illustrated as an example, positioning means 65 are provided on the standing surface 6 oriented parallel with a mid-axis 64, which serve as centering recesses 32 in which the positioning projections 31 of two adjacent spacer elements 30 for each carrier support 2 locate, preferably in the corner regions 29. Consequently, the carrier supports 2 are oriented in a position in which one of the side faces 38 extends parallel with and at a predefined distance 66 from the X-axis 60 and the other side face 38 extends at a right-angle to it.

The disposition of the positioning means 65 needed to obtain a reference position of the stacking shaft 3, in which a gripping finger 17 adjusted to a neutral central position on the panel 16 drops down more or less centrally into the stacking shaft 3 by reference to the manipulating device 5, is achieved due to the disposition of the positioning means 65 relative to the position of the X-axis 60 of the linear guide mechanism 8 as well as an end position 67 in the direction of the X-axis 60 of the gripping finger 17 and the predefined distance 66, making allowance for the dimensional design of the carrier support 2, such as a length 68, width 69 and a side distance 70 of the receiving grooves 37 and the disposition of the spacer elements 30 in the corner regions 39.

Since the size dimensions are known, the positioning means 65 can be positioned as a function of the position of the handling device 5 and linear guide mechanism 8 using a calculated X-co-ordinate of the surface center point 33 of the carrier support 2 or an intersection point 71 of the adjacent side faces 38 by reference to the end position 67 of the gripping mechanism 14.

It has been found that another advantageous embodiment is one whereby, if the separating device 1 is assigned two positioning spaces 27, a displacement path of the linear guide mechanism 8 between the end position 67 of the gripping mechanism 14 and an end position spaced apart from it is approximately the width 69 of the carrier support 2 plus a minimal distance between the carrier supports 2.

Consequently, as may be seen again from FIGS. 1 to 3, in one of the respective end positions and without the need to position the gripping mechanism 14 beforehand, the workpiece 4 can be picked up out of the stacking shaft 3 by placing the gripping means, e.g. vacuum sucker, magnet etc., on the workpiece 4 to be separated from the stacking shaft 3 and then raising the gripping mechanism 14 into a top end position—in the Y-axis—so that the workpiece is positioned above the stacking shaft 3. The subsequent movement of the gripping mechanism 14 together with the separated workpiece 4 into one of the two end positions—in the X-axis—is defined specifically for the transfer position 56 so that the workpiece can be transferred by a feeding system, e.g. a multi-axis robot for operating the bending press, which simplifies the motion sequence of the robot and reduces the work involved in programming and configuring the control system.

The embodiments illustrated as examples represent possible design variants of the separating device 1, and it should be pointed out at this stage that the invention is not specifically limited to the design variants specifically illustrated, and instead the individual design variants may be used in different combinations with one another and these possible variations lie within the reach of the person skilled in this technical field given the disclosed technical teaching. Accordingly, all conceivable design variants which can be obtained by combining individual details of the design variants described and illustrated are possible and fall within the scope of the invention.

For the sake of good order, finally, it should be pointed out that, in order to provide a clearer understanding of the structure of the separating device, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2, 3; 4, 5; 6 constitute independent solutions proposed by the invention in their own right. The objectives and associated solutions proposed by the invention may be found in the detailed descriptions of these drawings.

The invention claimed is:

1. A separating device for separating a top workpiece from one of several stacks of such workpieces stacked one upon another and transferring the workpiece into a transfer position, the separating device comprising:

a manipulating device supported on a standing surface and having a gripping mechanism for gripping and removing the top workpiece from one stack and conveying the workpiece from a pick-up position into the transfer position, the manipulating device being operable to move the gripping mechanism along at least a first, horizontal axis denoted as an X-axis and along a second, vertical axis denoted as a Y-axis so as to position the gripping mechanism above the stack and then lower the gripping mechanism to grip the top workpiece, the manipulating device having two positioning recesses spaced apart in the X-axis direction, and wherein a third, horizontal axis denoted as a Z-axis is mutually perpendicular to the X- and Y-axes; and a carrier support for supporting stacks of workpieces, the carrier support having first and second stacking shafts spaced apart in the X-axis direction for respectively supporting first and second stacks of workpieces;

the carrier support having a first pair of positioning projections spaced apart in the X-axis direction and a second pair of positioning projections spaced apart in the X-axis direction, the first and second pairs of positioning projections being spaced apart in the Z-axis direction;

the first pair of positioning projections being engageable in the positioning recesses when the carrier support is in a first orientation, which places one of the stacking shafts in a reference position enabling the gripping mechanism to grip the top workpiece in the stack of workpieces disposed therein;

the second pair of positioning projections being engageable in the positioning recesses when the carrier support is in a second orientation that is rotated 180° relative to the first orientation about a vertical axis passing through a center point of the carrier support, the second orientation placing another of the stacking shafts in the reference position.

2. The separating device according to claim 1, wherein the reference position is fixed by an X-coordinate of the center point of the carrier support by reference to an end position of the gripping mechanism in the X-axis direction and by a normal distance of the center point from the X-axis.

3. The separating device according to claim 1, wherein the reference position is fixed by an X-coordinate of an intersection point of adjoining side faces of the carrier support extending at a right angle to one another by reference to an end position of the gripping mechanism in the X-axis direction, and by a distance between the X-axis and a side face of the carrier support oriented parallel with the X-axis.

4. The separating device according to claim 1, wherein the manipulating device has a linear guide mechanism disposed on the standing surface and a tower-shaped housing extending perpendicular to the standing surface and displaceably guided in the linear guide mechanism by a displacement drive, on which the gripping mechanism is mounted so that the gripping mechanism can be displaced in the X-axis direction.

5. The separating device according to claim 4, wherein the gripping mechanism is provided in the form of a panel with at least one gripping finger, which is mounted so that the gripping mechanism can be displaced on the housing in a linear guide mechanism.

6. The separating device according to claim 4, wherein a displacement drive for the gripping mechanism is integrated in the housing.

7. The separating device according to claim 4, wherein the displacement drives are provided in the form of actuator means pressurized by means of a pressurizing medium.

8. The separating device according to claim 4, wherein the displacement drives are provided in the form of electric actuator drives.

9. The separating device according to claim 5, wherein the gripping finger is provided in the form of a support arm retained on the panel so as to be displaceable and, connected to the support arm, a spacer element extending in the direction of the standing surface.

10. The separating device according to claim 5, wherein the panel is mounted on a carriage of the linear guide mechanism by means of a pivot drive forming a pivot axis extending parallel with the standing surface.

11. The separating device according to claim 10, wherein a pivot range of the pivot drive is approximately 180°.

12. The separating device according to claim 10, wherein the pivot drive is provided in the form of a pneumatic actuator drive.

13. The separating device according to claim 10, wherein the pivot drive is provided in the form of an electric motor-driven actuator drive.

14. The separating device according to claim 9, wherein a gripper is provided on an end region of the spacer element facing the standing surface.

15. The separating device according to claim 14, wherein the gripper comprises a vacuum gripper and the spacer element is connected to a vacuum generator via a pressure line.

16. The separating device according to claim 15, wherein a shut-off valve is provided in the pressure line.

17. The separating device according to claim 14, wherein the gripper comprises an electromagnet and is connected via a line to a switching means of a control and regulating system of the separating device.

18. The separating device according to claim 1, wherein the carrier support is provided in the form of a supporting board that has receiving means in a top face thereof for receiving a plurality of shaft dividers forming each stacking shaft.

19. The separating device according to claim 18, wherein the receiving means are pro-vided in the form of several receiving grooves extending at right-angles with respect to one another.

20. The separating device according to claim 18, wherein the shaft dividers are provided in the form of panel-shaped wall parts retained in receiving grooves.

21. The separating device according to claim 18, the carrier support further comprising permanent magnets for retaining the shaft dividers in position.

22. The separating device according to claim 1, wherein the positioning projections are disposed on spacer elements of the carrier support that space a supporting board of the carrier support above the standing surface.

23. The separating device according to claim 22, wherein the positioning recesses that receive the positioning projections are formed in a base plate of a linear guide mechanism for gripping mechanism.

24. The separating device according to claim 1, wherein the gripping mechanism is provided with a measuring device for detecting double sheets.

25. The separating device according to claim 24, wherein the manipulating device includes a displacement drive for the gripping mechanism, and the measuring device comprises a force-measuring sensor with a connecting line to a control and regulating system disposed on a drive means of the displacement drive of the gripping mechanism.

26. The separating device according to claim 25, wherein the force-measuring sensor is provided in the form of a strain gauge disposed on a support arm of the gripping mechanism.

27. The separating device according to claim 1, wherein a releasing device is disposed in an area where the gripping mechanism moves, the releasing device being operable to separate a second workpiece from the top workpiece gripped by the gripping mechanism.

28. The separating device according to claim 1, wherein the carrier support includes first, second, third, and fourth stacking shafts for respectively supporting first, second, third, and fourth stacks of workpieces, the first and second stacking shafts being spaced apart in the X-axis direction, and the third and fourth stacking shafts being spaced apart in the X-axis direction and being spaced from the first and second stacking shafts in the Z-axis direction;

the carrier support further comprising a third pair of positioning projections spaced apart in the Z-axis direction, and a fourth pair of positioning projections spaced apart in the Z-axis direction and spaced in the X-axis direction from the third pair of positioning projections;

the carrier support being positionable in four different positions respectively rotated 90° apart about the vertical axis through the center point of the carrier support so as to place each of the stacking shafts in the reference position.

29. A separating device for separating a top workpiece from a stack of such workpieces stacked one upon another and transferring the workpiece into a transfer position, the separating device comprising:

a manipulating device supported on a standing surface and having a gripping mechanism for gripping and removing the top workpiece from the stack and conveying the workpiece from a pick-up position into the transfer position, the manipulating device being operable to move the gripping mechanism along at least a first, horizontal axis denoted as an X-axis and along a second, vertical axis denoted as a Y-axis so as to position the gripping mechanism above the stack and then lower the gripping mechanism to grip the top workpiece, the manipulating device having two positioning recesses spaced apart in the X-axis direction; and a carrier support for supporting the stack of workpieces, the carrier support comprising a supporting board having receiving grooves in a top face of the supporting board, the carrier support further comprising a stacking shaft in which the stack of workpieces is disposed, the stacking shaft being formed by a plurality of panel-shaped shaft dividers oriented perpendicular to the top face and retained in the receiving grooves in the supporting board, the carrier support further having a pair of positioning projections spaced apart in the X-axis direction;

the pair of positioning projections being engageable in the positioning recesses of the manipulating device, which places the stacking shaft in a reference position enabling the gripping mechanism to grip the top workpiece in the stack of workpieces disposed therein.

30. The separating device of claim 29, further comprising permanent magnets on the carrier support for retaining the shaft dividers in position.

31. A separating device for separating a top workpiece from a stack of such workpieces stacked one upon another and transferring the workpiece into a transfer position, the separating device comprising:

a manipulating device supported on a standing surface and having a gripping mechanism for gripping and removing the top workpiece from the stack and conveying the workpiece from a pick-up position into the transfer position, and a displacement drive for the gripping mechanism, the displacement drive being operable to move the gripping mechanism along at least a first, horizontal axis denoted as an X-axis, the gripping mechanism also being movable along a second, vertical axis denoted as a Y-axis, whereby the gripping mechanism is positionable above the stack and movable to lower the gripping mechanism to grip the top workpiece, the manipulating device having two positioning recesses; and a carrier support for supporting the stack of workpieces, the carrier support including a stacking shaft in which the stack of workpieces is disposed, the carrier support further having a pair of positioning projections, the pair of positioning projections being engageable in the positioning recesses of the manipulating device, which places the stacking shaft in a reference position enabling the gripping mechanism to grip the top workpiece in the stack of workpieces disposed therein;

the gripping mechanism including a measuring device for detecting when two workpieces adhered together have been picked up by the gripping mechanism, the measuring device comprising a force-measuring sensor connected to a control and regulating system for the separating device, the force-measuring sensor being disposed on a drive means for the displacement drive of the gripping mechanism or on a gripping finger of the gripping mechanism.

32. The separating device of claim 31, wherein the force-measuring sensor comprises a strain gauge disposed on a support arm of the gripping mechanism.

* * * * *